US008839804B2

(12) United States Patent
Phillips et al.

(10) Patent No.: US 8,839,804 B2
(45) Date of Patent: Sep. 23, 2014

(54) CONDUCTOR CLEANING SYSTEM

(75) Inventors: Andrew Phillips, Charlotte, NC (US); Andrew H. Stewart, Fort Collins, CO (US); Shridas Ningileri, Lexington, KY (US); Neil J. Hurst, Fort Collins, CO (US); J. Finley Bush, Leechburg, PA (US); Sike Xia, Pearland, TX (US); Chenghe Xiao, Lexington, KY (US)

(73) Assignee: Electric Power Research Institute, Inc., Charlotte, NC (US)

( * ) Notice: Subject to any disclaimer, the term of this patent is extended or adjusted under 35 U.S.C. 154(b) by 723 days.

(21) Appl. No.: 12/357,610

(22) Filed: Jan. 22, 2009

(65) Prior Publication Data

US 2010/0180921 A1 Jul. 22, 2010

(51) Int. Cl.
*B08B 3/12* (2006.01)
*B08B 3/04* (2006.01)
*B08B 3/10* (2006.01)

(52) U.S. Cl.
CPC .... *B08B 3/04* (2013.01); *B08B 3/10* (2013.01)
USPC ..... 134/184; 134/186

(58) Field of Classification Search
CPC ..... B08B 3/04; B08B 3/10
USPC ..... 134/184, 186
See application file for complete search history.

(56) References Cited

U.S. PATENT DOCUMENTS 1,428,528 A * 9/1922 Bryan ..... 15/264
1,979,241 A * 11/1934 Albanese et al. ..... 206/362
2,650,872 A * 9/1953 Goldwasser ..... 8/159
2,802,476 A * 8/1957 Kearney ..... 134/74
2,828,231 A * 3/1958 Henry ..... 134/1
3,043,724 A * 7/1962 Balshaw ..... 134/25.2
3,291,458 A 12/1966 Hamm
3,291,640 A 12/1966 Livingston
3,481,687 A * 12/1969 Fishman ..... 422/20
3,525,243 A * 8/1970 Chrablow ..... 72/39
3,526,458 A * 9/1970 Meyers et al. ..... 355/45
3,688,785 A * 9/1972 Stevens et al. ..... 134/138
3,698,408 A * 10/1972 Jacke ..... 134/122 R
3,937,236 A * 2/1976 Runnells ..... 134/184

(Continued)

FOREIGN PATENT DOCUMENTS

DE 2145664 3/1973
DE 3240467 5/1984

(Continued)

OTHER PUBLICATIONS

European Patent Office 0 624 661 Nov. 1994.*

(Continued)

*Primary Examiner* — Joseph L Perrin
*Assistant Examiner* — Kevin G Lee
(74) *Attorney, Agent, or Firm* — Trego, Hines & Ladenheim, PLLC

(57) ABSTRACT

A conductor cleaning system for cleaning aluminum strands of all aluminum and steel reinforced conductors, such as ACSS, ACSR, ACAR, and AAA. The conductor cleaning system having a container adapted to receive a portion of a conductor to be cleaned, a housing adapted to receive and support the container, and a cleaning solution contained in the container for cleaning the portion of the conductor. The cleaning solution being adapted to clean the conductor without reacting with or damaging the conductor.

11 Claims, 13 Drawing Sheets

(56) References Cited

U.S. PATENT DOCUMENTS

| | | | | | |
|---|---|---|---|---|---|
| 4,167,341 | A | * | 9/1979 | Doyel | 366/114 |
| 4,272,300 | A | | 6/1981 | Burtelson | |
| 4,326,316 | A | | 4/1982 | Dolenti | |
| 4,503,577 | A | * | 3/1985 | Fowler | 15/88 |
| 4,605,027 | A | * | 8/1986 | Dallot | 134/108 |
| 4,727,734 | A | * | 3/1988 | Kanazawa et al. | 68/3 SS |
| 4,763,677 | A | * | 8/1988 | Miller | 134/105 |
| 4,991,609 | A | * | 2/1991 | Browning | 134/57 R |
| 5,076,305 | A | * | 12/1991 | Williams | 134/58 R |
| 5,319,823 | A | | 6/1994 | Baum et al. | |
| 5,409,594 | A | * | 4/1995 | Al-Jiboory et al. | 205/148 |
| 5,571,336 | A | | 11/1996 | Wurzburger et al. | |
| 5,711,327 | A | * | 1/1998 | Fields | 134/105 |
| 5,803,099 | A | * | 9/1998 | Sakuta et al. | 134/56 R |
| 6,695,164 | B1 | * | 2/2004 | Chayer | 220/735 |
| 6,719,850 | B2 | * | 4/2004 | Glucksman et al. | 134/1 |
| 7,107,596 | B2 | * | 9/2006 | Brown et al. | 719/316 |
| 7,299,662 | B2 | * | 11/2007 | Hielscher | 68/3 SS |
| 7,451,772 | B2 | * | 11/2008 | Gilbert et al. | 134/135 |
| 7,500,402 | B2 | * | 3/2009 | Pors et al. | 73/861.28 |
| 7,647,665 | B2 | * | 1/2010 | Disbrow | 15/88 |
| 7,748,524 | B2 | * | 7/2010 | Ruzumna | 206/209 |
| 2009/0056756 | A1 | * | 3/2009 | Son | 134/18 |

FOREIGN PATENT DOCUMENTS

| | | | |
|---|---|---|---|
| DE | 40 90 721 | * | 10/1991 |
| FR | 2 478 356 | * | 9/1981 |
| GB | 548960 | | 10/1942 |
| GB | 2 026 035 | * | 1/1980 |
| JP | 06-235086 | * | 8/1994 |

OTHER PUBLICATIONS

WIPO WO 90/04172 Apr. 1990.*
WIPO WO 95/12804 May 1995.*
Machine translation of DE3240467.*
Machine translation of DE4009721.*
Machine translation of JP 06-235086 A, dated Aug. 1994.*
Small Conductor Cleaning Brush. Catalog [online]. Utility Solutions, Inc., 2009. [retrieved on Mar. 23, 2009]. Retrieved from the Internet: <URL: http://www.utilitysolutionsinc.com//utilitycatalog/product.cfm?PID=2889>.
Conductor Cleaning Brushes. Catalog [online]. Hastings, 2009. [retrieved on Mar. 23, 2009]. Retrieved from the Internet: <URL: http://www.hfgp.com/images/catalog/F-6-1.gif>.
Ultrasonic Cleaning. Catalog [online]. SonicWise, 1999. [retrieved on Mar. 23, 2009]. Retrieved from the Internet: <URL: http://www.sonicwise.com/>.
Ultrasonic Cleaner Equipment. Catalog [online]. Omegasonics Corporation, 2009. [retrieved on Mar. 23, 2009]. Retrieved from the Internet: <URL: http://www.omegasonics.com/index.shtml>.
Pollution Prevention Project Report. P2 Brief [online]. Jupiter Aluminum Corp, 1999. [retrieved on Mar. 23, 2009]. Retrieved from the Internet: <URL: https://engineering.purdue.edu/CMTI/Technology_Transfer/Jupitp2- web.htm>.
Aluminum Cleaners for Electroplating & Anodizing. Catalog [online]. Electrochemical Products, Inc., 2009. [retrieved on Mar. 23, 2009]. Retrieved from the Internet: <URL: http://www.epi.com/pages/aluminium-cleaners>.
Aluminum Cleaning Detergents. Catalog [online]. Alconox, Inc., 2001. [retrieved on Mar. 23, 2009]. Retrieved from the Internet: <URL: http://metal-cleaning.alconox.com/cleaning_aluminum.htm>.

* cited by examiner

CONDUCTOR CLEANING SYSTEM

BACKGROUND OF THE INVENTION

The present invention relates generally to a conductor cleaning system, and more particularly to a system for cleaning aluminum strands of all aluminum and steel reinforced conductors, such as ACSS, ACSR, ACAR, and AAA.

In current power transmission systems, failures can pose a significant risk to the reliability of the system. There are several factors that contribute to these failures—one such factor is the failure of compression connectors.

Current data suggests that a primary root cause for failures in compression connectors is improper installation. Examples of improper installation include lack of compound, alignment, wrong die, and poor cleaning of the aluminum strands of the conductor prior to installation of compression connectors. Research indicates that corrosion products and other contaminants (resulting from years of exposure to the environment) left on the conductors during splice assembly can raise the resistance of the splice-conductor joint. Cyclical variations of load current feeding through the increased resistance of the splice-conductor joint causes thermal expansion/contraction that eventually reduces the grip of the splice to a point where it can no longer hold the conductor.

Currently, compression connector installers clean the aluminum strands with a wire brush, which results in ineffective cleaning of the strands, leaving corrosion products and other contaminants behind. Further, the installer cannot clean internal strands using the wire brush unless the installer takes the time to unstrand the conductor. Unfortunately, unstranding is impractical in most field conditions and can increase the risk of damage to the individual strands.

Accordingly, there is a need for a conductor cleaning system that can effectively clean both outer and inner strands of a conductor without the need to unstrand the conductor.

BRIEF SUMMARY OF THE INVENTION

These and other shortcomings of the prior art are addressed by the present invention, which provides a conductor cleaning system capable of cleaning external and internal strands of a conductor without unstranding the conductor.

According to one aspect of the present invention, a conductor cleaning system includes a container adapted to receive a portion of a conductor to be cleaned, a housing adapted to receive and support the container, and a cleaning solution contained in the container for cleaning the portion of the conductor. The cleaning solution is adapted to clean the conductor without reacting with or damaging the conductor.

According to another aspect of the present invention, a conductor cleaning system includes a container adapted to contain a cleaning solution and receive a portion of a conductor to be cleaned, a housing adapted to receive and support the container, and a control system contained in the housing. The control system includes a motor and a vibrator to impart vibrations into the container such that the cleaning solution is agitated.

According to another aspect of the present invention, a conductor cleaning system includes a container adapted to receive a portion of a conductor to be cleaned, a housing adapted to receive and support the container, a cleaning solution, and a control system. The cleaning solution is contained in the container for cleaning the portion of the conductor and is adapted to clean the conductor without reacting with or damaging the conductor. The control system is contained in the housing and includes a motor operably connected to a vibrator. The vibrator includes an eccentric weight adapted to be spun by the motor at a specified rate to impart vibrations into the container such that the cleaning solution is agitated.

BRIEF DESCRIPTION OF THE DRAWINGS

The subject matter that is regarded as the invention may be best understood by reference to the following description taken in conjunction with the accompanying drawing figures in which.

DETAILED DESCRIPTION OF THE INVENTION

Figure 1:
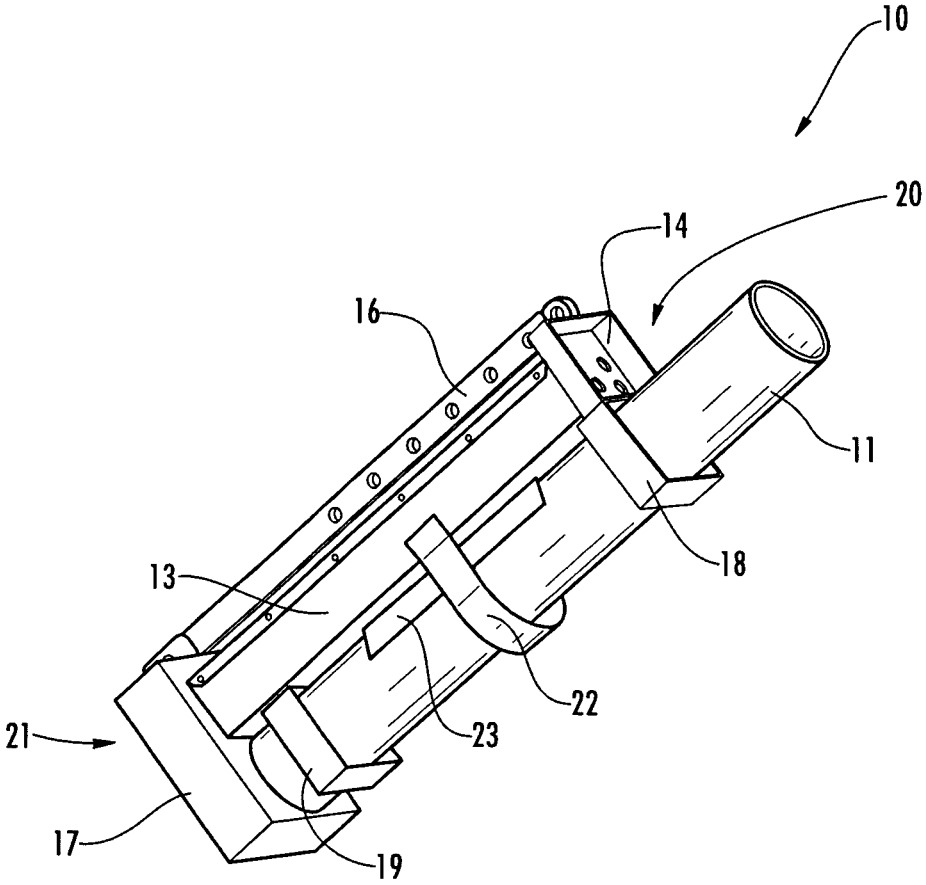
FIG. 1 is a perspective view of a conductor cleaning system according to an embodiment of the invention.

Referring to the drawings, an exemplary conductor cleaning system according to the present invention is illustrated in FIG. 1 and shown generally at reference numeral 10. The system 10 includes a container, such as tube 11 operably connected to a vibrator 12, FIG. 2, contained in a vibrator housing 13, and a control panel 14 for controlling the system 10. The container 11 may be disposable or permanently attached to the system 10.

Figure 8:
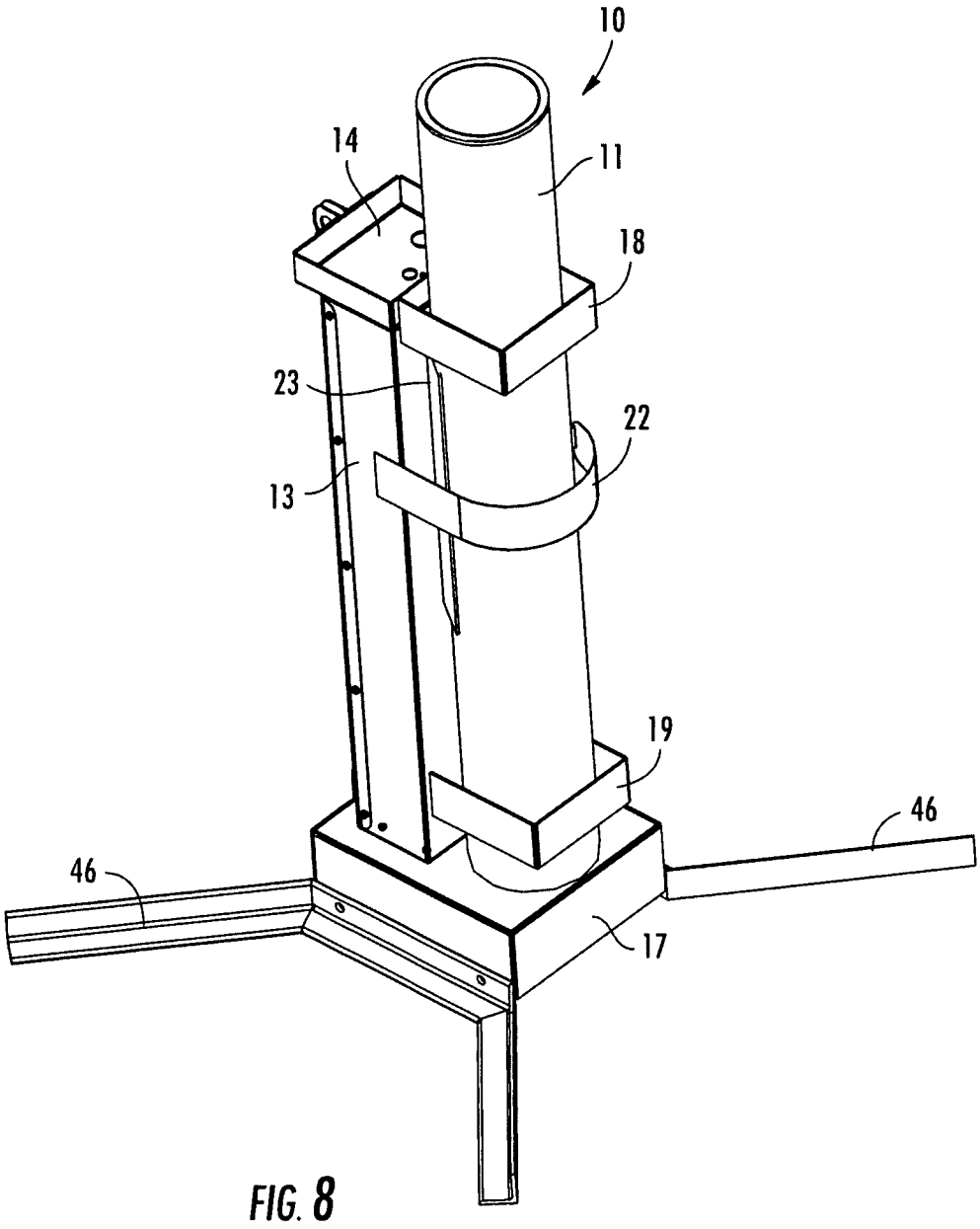
FIGS. 8-10 show the conductor cleaning system of FIG. 1 supported in an upright position by supports.
Figure 9:
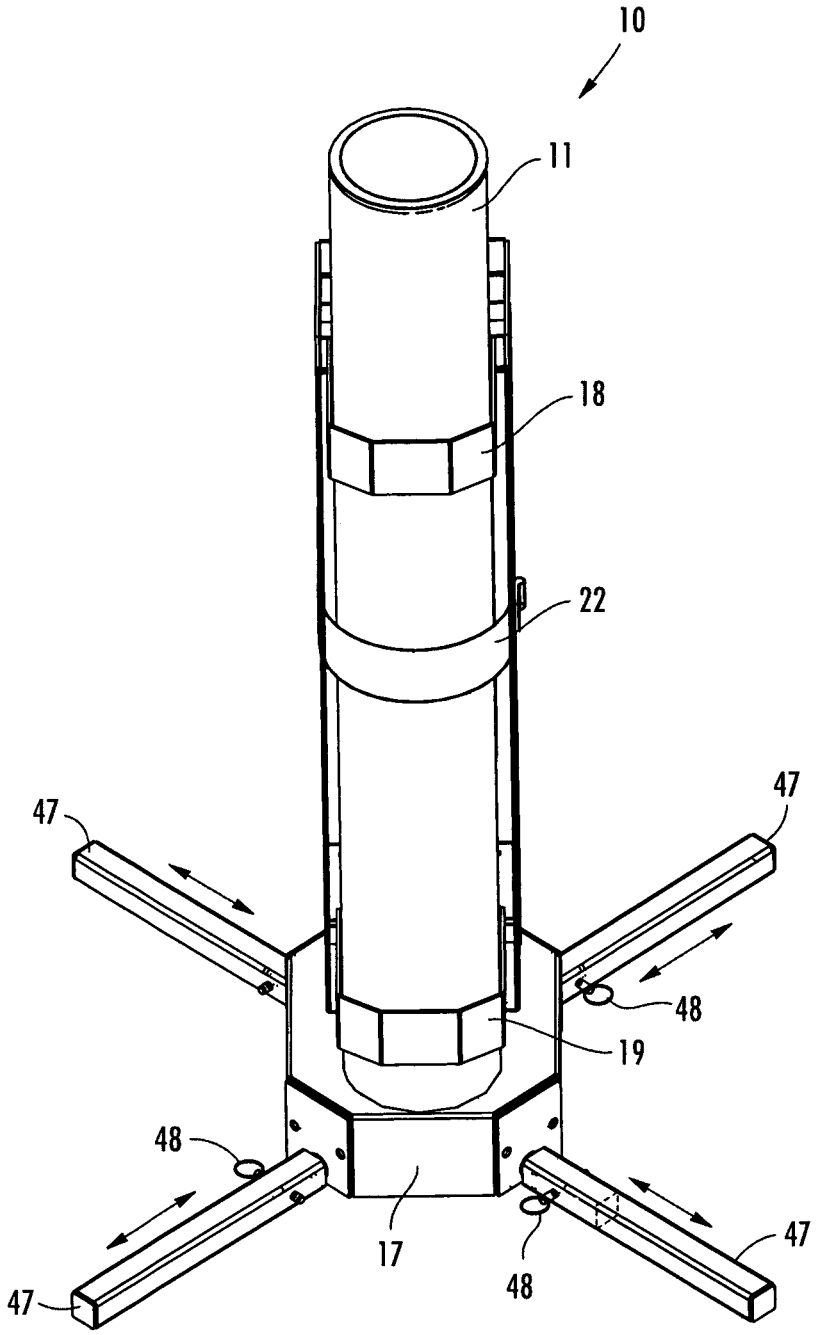
Figure 10:
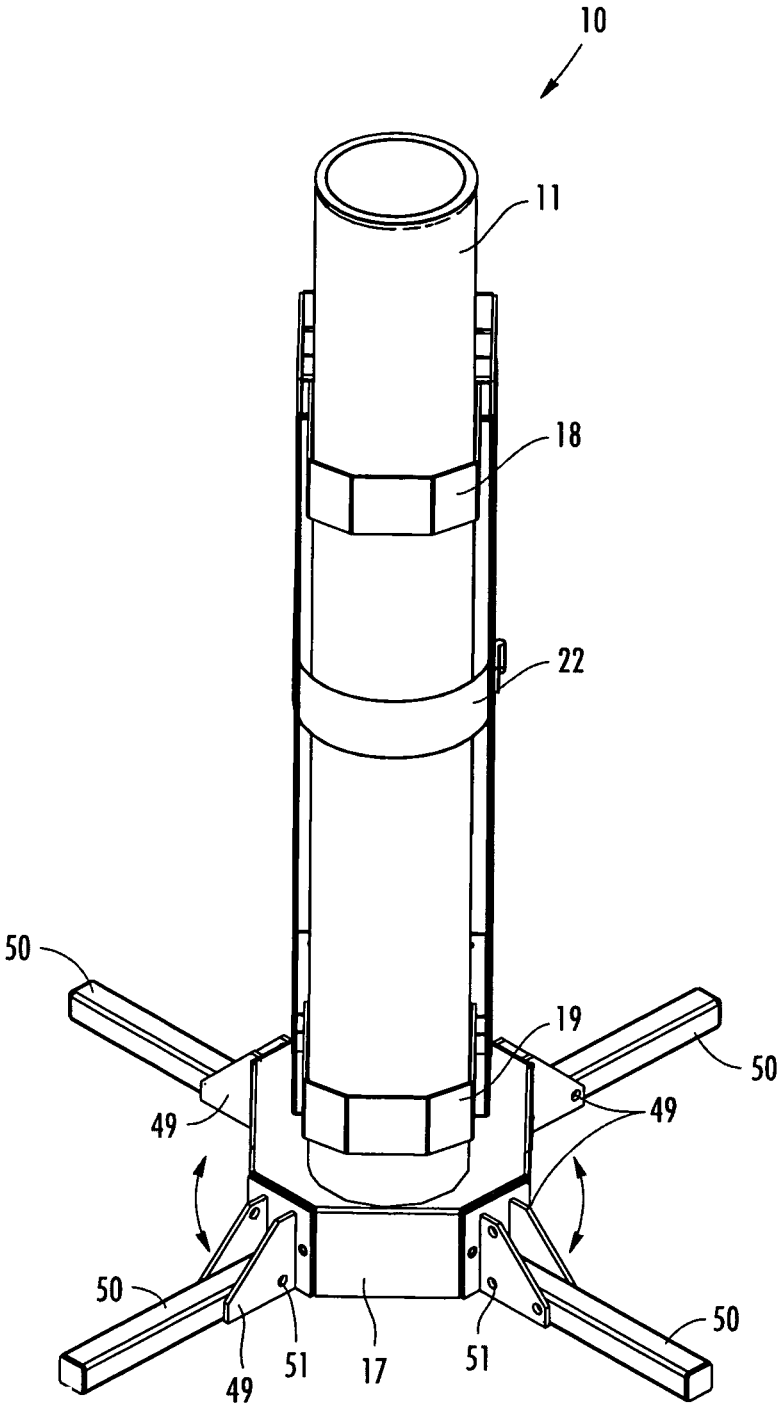

The vibrator housing 13 is adapted to receive and support the container 11, and includes an attachment rail 16 to allow the system 10 to be attached to a support for easy operation or to allow a user to easily carry the system 10. Other attachments such as a hook-type attachment may also be used to attach the system 10 to a bucket of a bucket truck or other suitable support. A standing base 17 is disposed at one end of the housing 13 to allow the system 10 to be positioned in a stand-up position such that the tube 11 is in a vertical position. The base 17 may be adapted to accept supports to further stabilize the system 10 in the vertical position, as shown in FIGS. 8-10. Guide straps 18 and 19 are attached to opposing ends 20 and 21 of the housing 13 to provide guides and supports for the tube 11, and a retaining strap 22 is positioned between the guide straps 18 and 19 to lock the tube 11 into position. A support 23 is also positioned on a bottom of the housing 13 to further position and lock the tube 11 into position. As shown, the support 23 is V-shaped; however, any suitable geometry may be used to position and lock the tube 11 in position.

Figure 2:
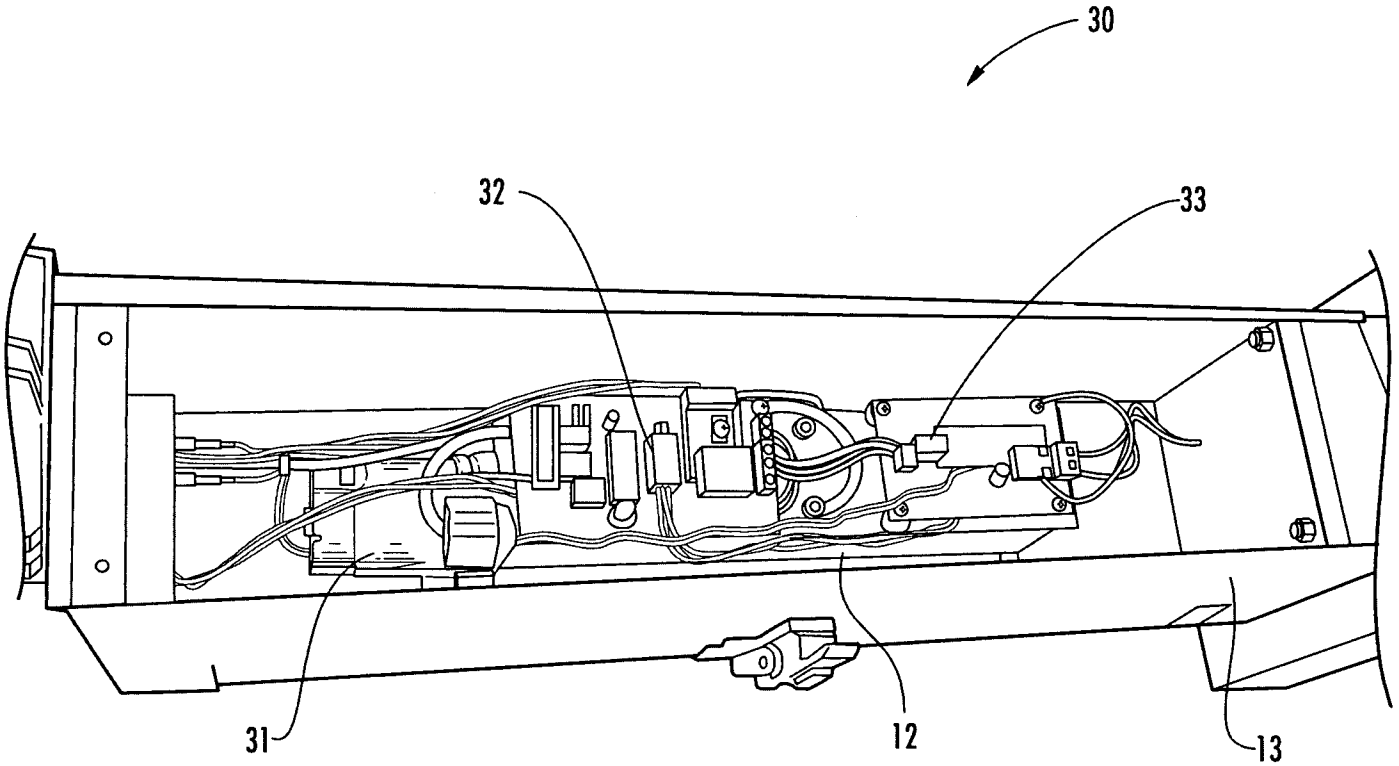
FIG. 2 shows a vibrator housing of the conductor cleaning system of FIG. 1.
Figure 3:
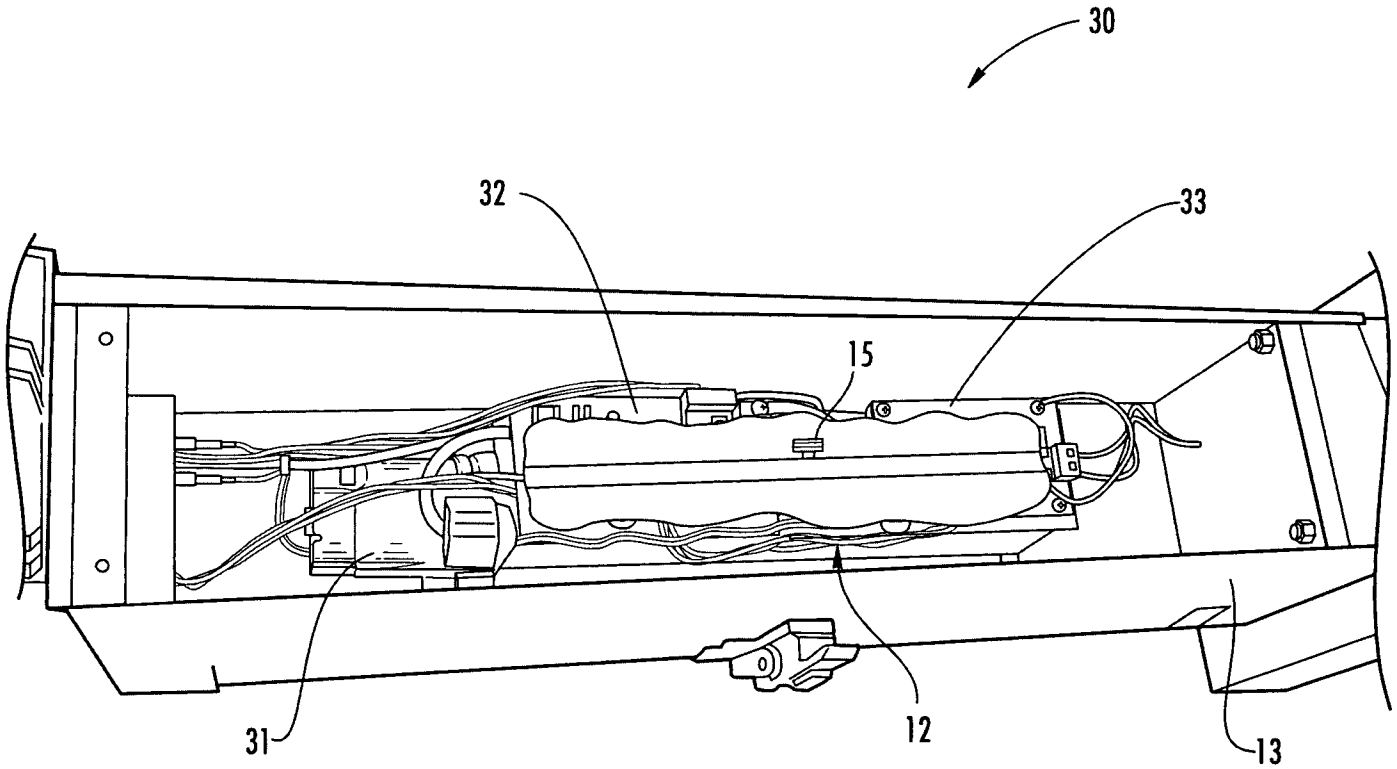
FIG. 3 shows an eccentric weight for use in a vibrator of the conductor cleaning system of FIG. 1.

As shown in FIG. 2, the vibrator housing 13 includes a control system 30 having an electric motor 31, a timer circuit 32, a voltage regulator 33, and the vibrator 12. The vibrator 12 includes an eccentric weight 15, like that shown in FIG. 3, to emit vibrations into the tube 11, thereby agitating a cleaning solution contained therein. Together, the motor 31 and vibrator 12 cause the system 10 to vibrate at a specified rate by spinning the eccentric weight 15 at a desired speed. It should be appreciated that the speed of the motor 31 and size of the eccentric weight 15 may be changed to optimize the conductor cleaning efficiency.

Figure 4:
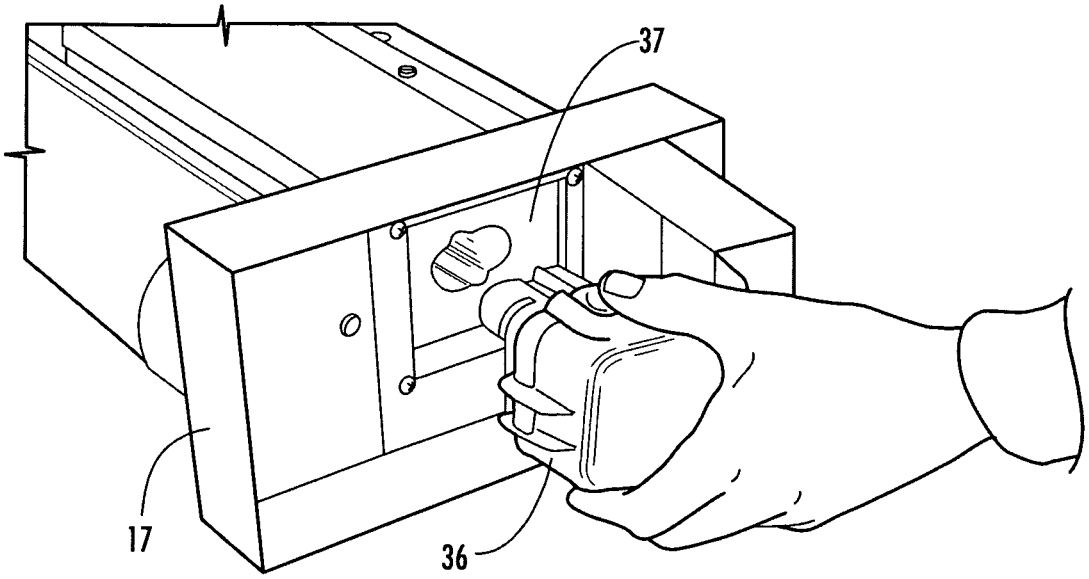
FIG. 4 shows a battery and receptacle for the conductor cleaning system of FIG. 1.

Referring to FIG. 4, the system 10 is powered by a battery 36. The battery 36 is contained in a battery receptacle 37 of the base 17. The battery 36 may be replaceable or rechargeable and allows the system 10 to be portable for conductor cleaning both at ground level and at elevated levels.

Figure 5:
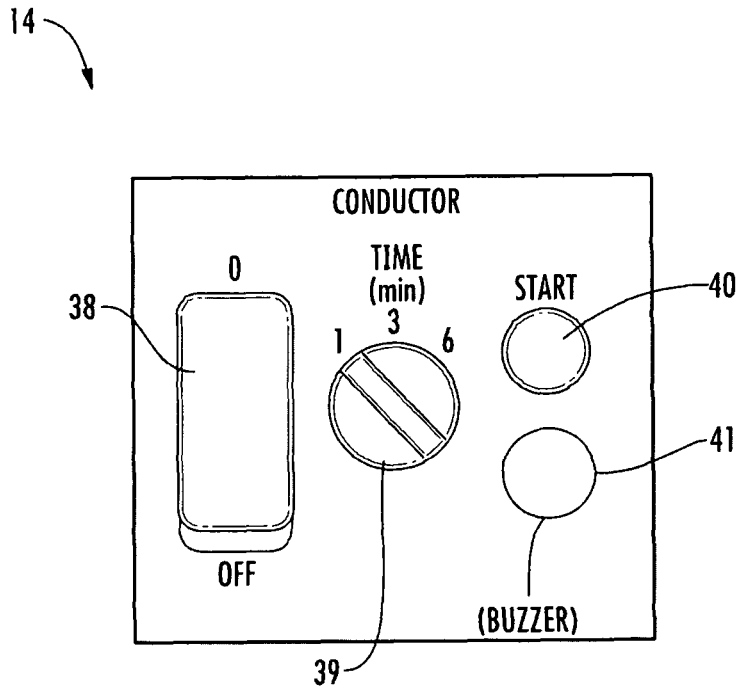
FIG. 5 shows a control panel for the conductor cleaning system of FIG. 1.

As illustrated in FIG. 5, the control panel 14 is electrically connected to the control system 30 and includes a power switch 38, a timer 39, a start button 40, and a buzzer 41. The power switch 38 turns the system 10 on to a ready state so that the system 10 is ready to clean a conductor. The timer 39 allows a user to choose how long the cleaning process is going to last. The amount of time chosen is dependent on the level of contaminants and corrosion products on the surface of the conductor, temperatures, and other factors. The start button 40 turns the cleaning process on when depressed, and the buzzer 41 lets a user know when the cleaning process has ended.

The cleaning solution is contained in the tube 11 to allow an end of a conductor to be cleaned properly while reducing spills and splashes. The cleaning solution is designed and optimized to permit cleaning of aluminum strands of conductors without unstranding the conductor. Namely, the cleaning solution is designed to permit internal and external cleaning of aluminum strands of the conductor without reacting and damaging the galvanization of galvanized steel strands; to not react with or degrade aluminum strands after the cleaning process is complete; to clean over a wide range of temperatures; to not react with inhibitor compounds used in compression connector installation; and to be environmentally acceptable.

The cleaning solution uses a caustic solution of sodium hydroxide (NaOH) as a cleaning agent due to the tri-hydrated oxide of aluminum found in corrosion products being soluble in this type of solution. The caustic level of the solution is equal to, or less than, that of standard household cleaners. A low concentration of sodium fluoride (NaF) enhances the solubility of the aluminum oxides and reduces the time needed to complete the cleaning. The predominant reactions occurring during cleaning are as follows:

$$Al_2O_3+2NaOH \Leftrightarrow 2NaAlO_2+H_2O$$

$$2Al+2NaOH+2H_2O \rightarrow 2NaAlO_3+3H_2.$$

The reaction products are essentially stable and do not react with Al and the corrosion layer $Al_2O_3$. Only NaOH chemically attacks both Al and $Al_2O_3$. Examples of cleaning solutions are shown in the Table below.

| Solution | | |
|---|---|---|
| No. | Composition | Caustic Level |
| 1 | $NaOH + H_2O$ | High |
| 2 | $NaOH + NaPO_4 \cdot 12H_2O + NaF + H_2O$ | Medium |
| 3 | $NaOH + NaPO_4 \cdot 12H_2O + NaF + H_2O$ | Medium-Low |
| 4 | $NaOH + NaF + H_2O$ | Low |

In testing, all of the above solutions provided good to excellent cleaning results. For example, in one test, a cleaning solution having a low level of causticity and relatively simple composition was chosen. The cleaning solution had the following concentrations:

Sodium Hydroxide (NaOH)=20 g
Sodium Fluoride (NaF)=15 g
Water ($H_2O$)=1 L.

It should be appreciated that other concentrations could be used depending on the application. The chemicals were mixed in the water until completely dissolved. It was determined that the level of cleaning and the time to achieve that level were dependent on the solution temperature and the amount of agitation provided to the solution by the vibrator 12. This can be seen in the table below.

| | Cleaning Effectiveness Rated 0 to 5 with 5 Being the Best | | | | | |
|---|---|---|---|---|---|---|
| Temperature | With Agitation | | | Without Agitation | | |
| (C.) | 1 Min | 2.5 Min | 5 Min | 1 Min | 2.5 Min | 5 Min |
| 0 | 3 | 4 | 4 | 1 | 1 | 2 |
| 25 | 4 | 5 | 5 | 2 | 3 | 4 |
| 50 | 5 | 5 | 5 | 5 | 5 | 5 |
| 70 | 5 | 5 | 5 | 5 | 5 | 5 |

It should be appreciated that other forms of agitation may be used, such as ultrasonic.

Figure 6:
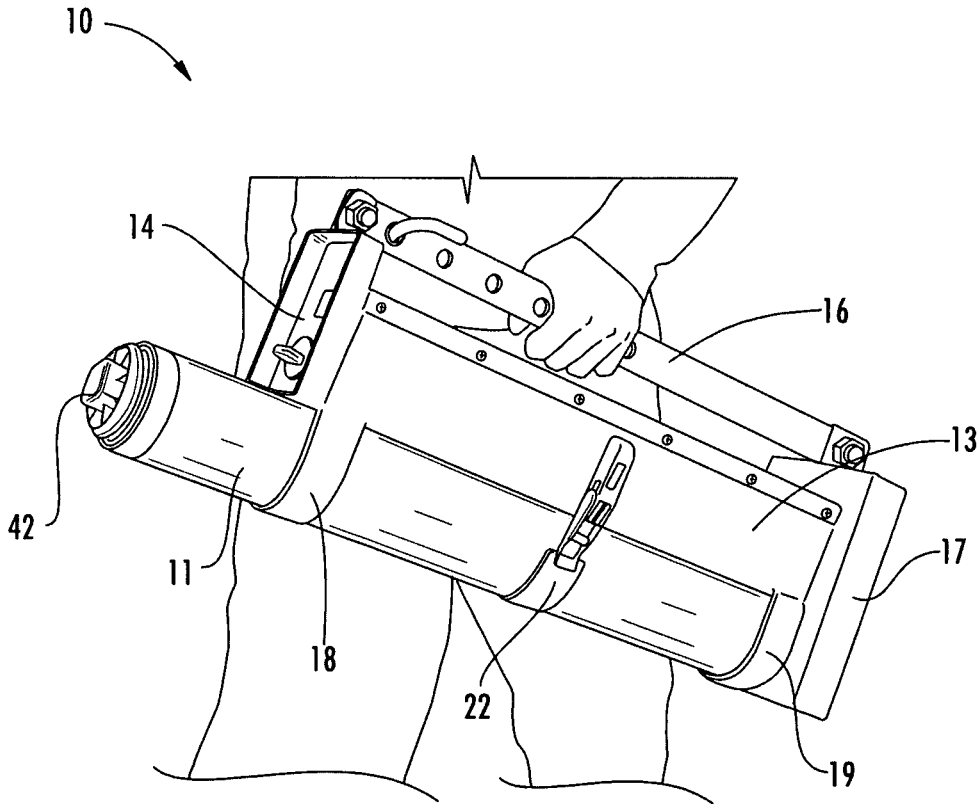
FIG. 6 shows the conductor cleaning system of FIG. 1 being carried.

In use, the tube 11 is inserted through the guide straps 18 and 19 of the vibrator housing 13 and secured in position by the retaining strap 22 and support 23. As discussed, the tube 11 may be disposable or permanently attached to the system 10. In the case of a disposable tube, the tube 11 may be pre-filled with the cleaning solution and a plug 42 would be inserted into an end of the tube 11 to prevent spilling of the solution. The tube would then be attached to the system 10 and carried, as shown in FIG. 6, to the conductor cleaning site. After use, the tube 11 would be removed from the system 10 and the tube and cleaning solution would be properly disposed of.

In the case of a permanent tube, the tube 11 would be attached to the system 10 and carried to the conductor cleaning site. The cleaning solution could be poured into the tube 11 and sealed therein by the plug 42 prior to delivery to the cleaning site, could be delivered to the site in another container and then poured into the tube at the site, or could be in powder form which would be mixed with water at the site.

Figure 7:
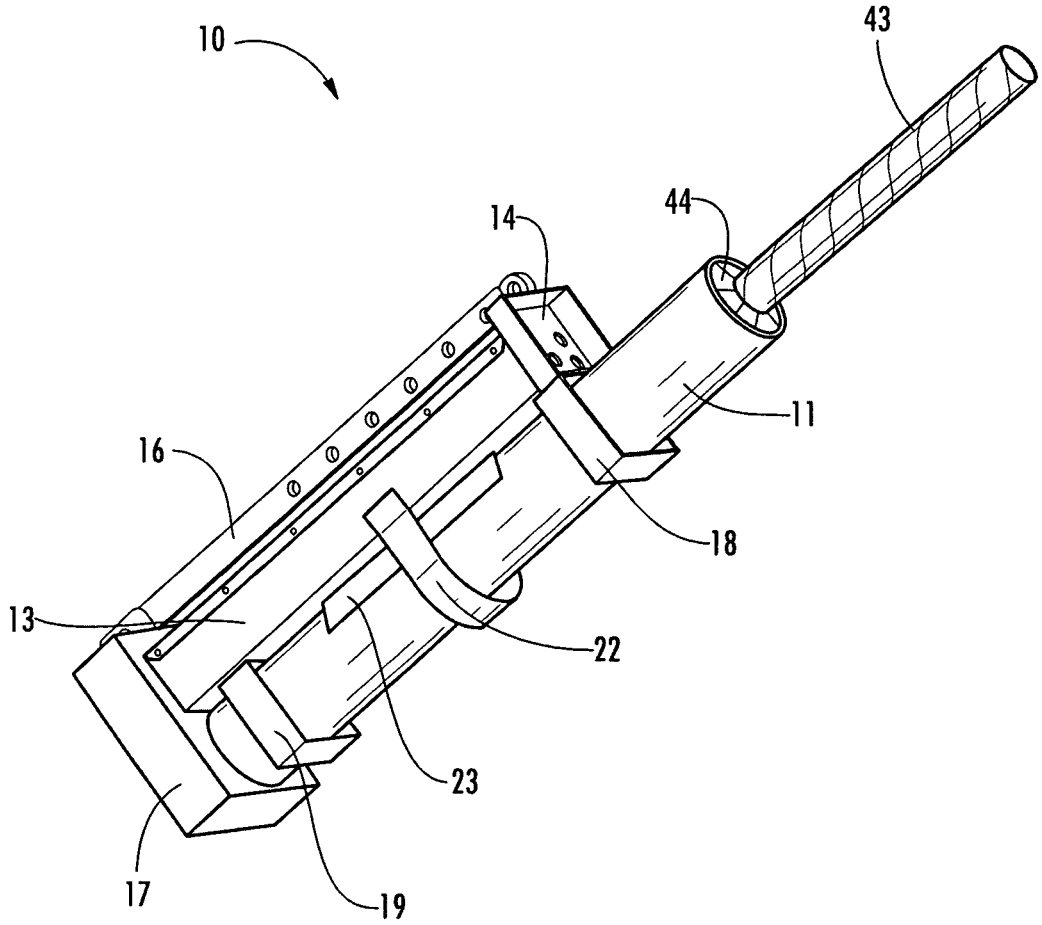
FIG. 7 shows the conductor cleaning system of FIG. 1 in use.

Referring to FIG. 7, once at the conductor cleaning site, a conductor 43 is inserted into the tube 11 so that the cleaning solution contained therein may clean the strands of the conductor 43. A baffle 44 may be inserted into the end of the tube 11 to prevent splashing during the cleaning process. With the conductor 43 positioned in the cleaning solution, the power switch 38 is moved to the on position and the timer 39 is moved to a desired time limit. The duration of vibration is determined by the user depending on the present temperature and the amount of deposits on the conductor surfaces. The start button 40 is then depressed and the motor rotates the eccentric weight 15 of the vibrator 12, thereby causing vibrations to agitate the cleaning solution to ensure that internal and external strands of the conductor are cleaned.

As discussed, during the cleaning cycle of the conductor, the system 10 may be supported in various ways to relieve the burden, on the user, of supporting the system 10. For example, if the system is to be supported in a vertical position, supports may be attached to the base 17, FIGS. 8-10. As shown in FIG. 8, legs 46 are directly attached to the base 17. Legs 46 may be secured to the base 17 using fasteners. As illustrated in FIG. 9, removable legs 47 are secured to the base 17 by pins 48. This allows the legs 47 to be removed when supporting the system 10 in a vertical position is not necessary. As shown in FIG. 10, foldable legs 50 are secured to the base 17 by supports 49 which allow the legs 50 to pivot between a use position and a non-use position about pin 51.

Figure 11:
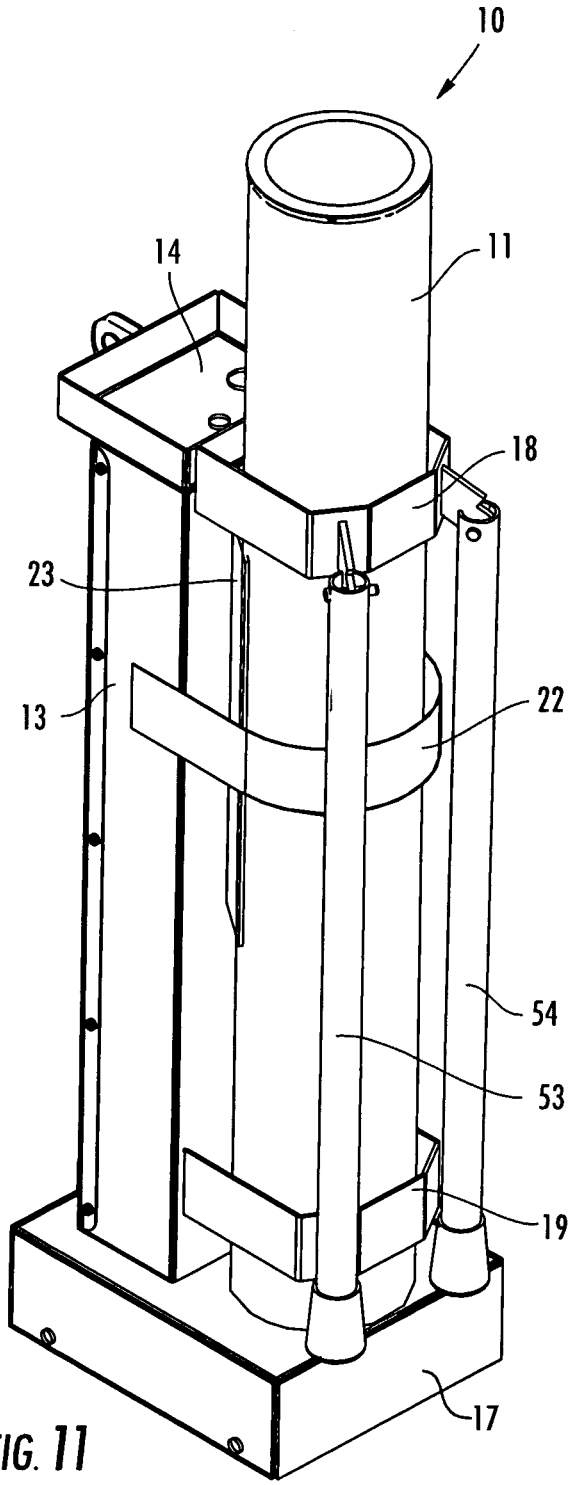
FIG. 11 shows the conductor cleaning system of FIG. 1 fitted with bi-pods.
Figure 12:
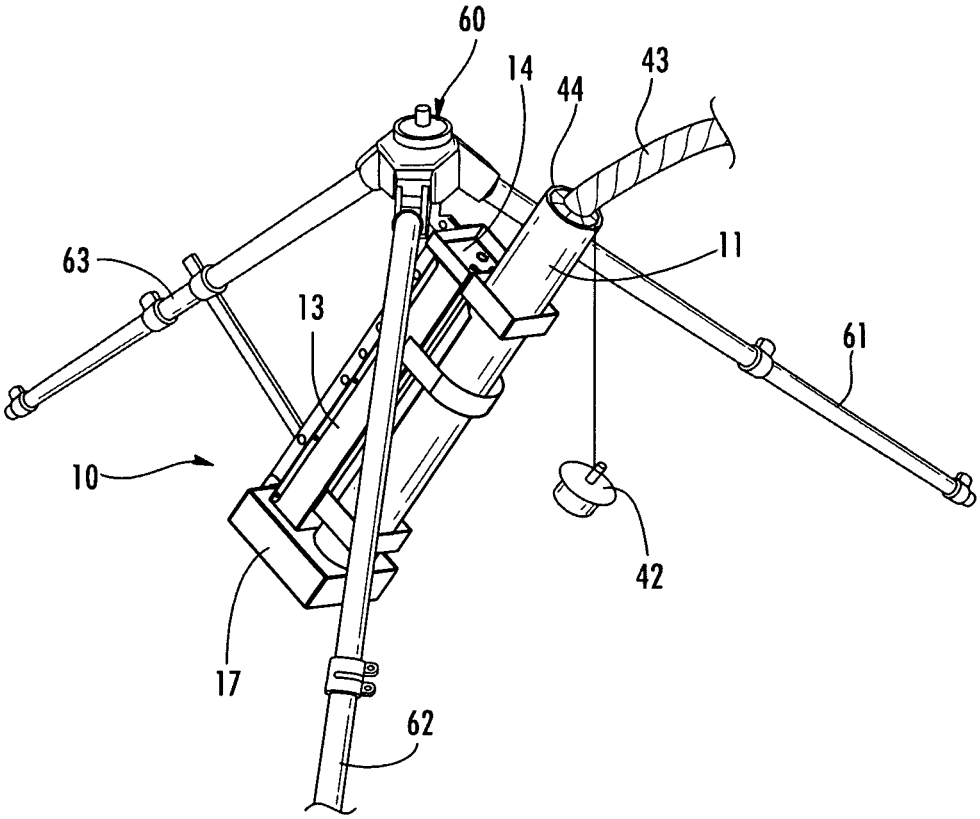
FIG. 12 shows a tri-pod for supporting the conductor cleaning system of FIG. 1.

Other support methods may also be employed. For example, in FIG. 11, a bi-pod having legs 53 and 54 may be attached to strap 18. The legs 53 and 54 may be moved between a use position and a non-use position to allow the system 10 to be supported in a non-vertical position. As shown in FIG. 12, a tri-pod 60 may also be used to support the system 10. As shown, the tri-pod 60 includes adjustable legs 61, 62, and 63 to allow for adjustment on uneven surfaces. The system 10 is then hung from the tri-pod 60 using the attachment rail 16.

Figure 13:
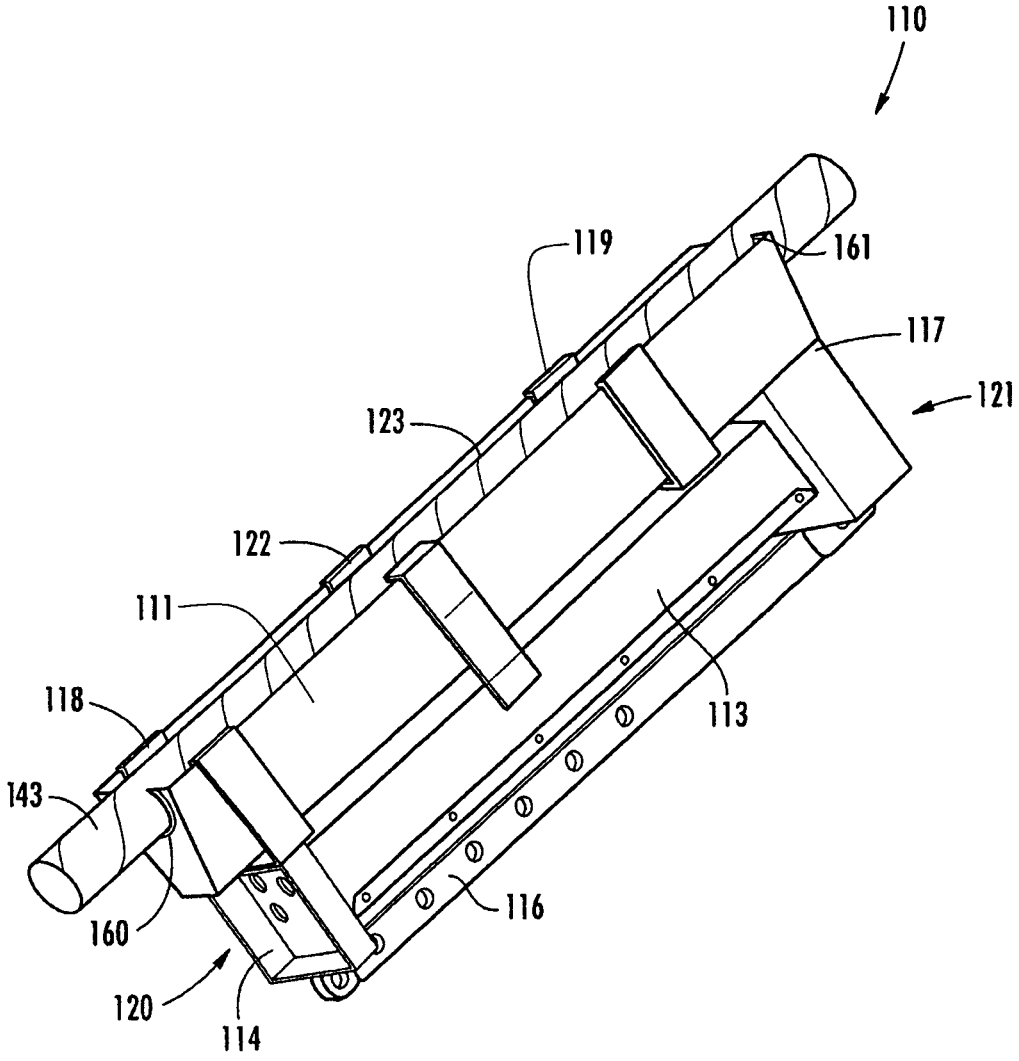
FIG. 13 is a perspective view of a conductor cleaning system according to an embodiment of the invention.

Referring to FIG. 13, a conductor cleaning system 110 is shown. Like system 10, system 110 includes a container 111 operably connected to a vibrator contained in a vibrator housing 113, a control panel 114, an attachment rail 116, a base 117, and retaining straps 118, 119, and 122. Unlike system 10, the container 111 of system 110 is a trough-like container to allow cleaning of a conductor 143 at a point intermediary of opposing ends of the conductor 143 without cutting. This allows the conductor 143 to be cleaned at locations where compression fittings, such as repair sleeves and T-connections, are being installed along the conductor 143.

In use, the container 111 is positioned at a point along the conductor 143 where cleaning is desired and moved into engagement with the conductor 143. Seals 160 and 161 permit the conductor 143 to be pressed into the container 111 until the conductor 143 is immersed in the cleaning solution. The seals 160 and 161 prevent the cleaning solution from leaking between the container 111 and the conductor 143.

The foregoing has described a conductor cleaning system. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

We claim:

1. A portable electrical conductor cleaning system, comprising:

(a) a removable tubular container adapted to contain a cleaning solution and receive a portion of a conductor to be cleaned;

(b) a housing adapted to receive and support the container, the housing having:

(i) a vibrator contained therein to impart vibrations into the container; and (ii) a support disposed on a bottom of the housing, the support being adapted to contact a portion of the container such that when the container is assembled with the housing, a surface of the container is in direct physical contact with the support to allow the vibrator to impart vibrations into the container, thereby agitating a cleaning solution contained therein; and (c) at least one guide strap connected to the housing, such that when assembled, the container is slid between the at least one guide strap and the support to position the container in parallel relation to the housing.

2. The portable electrical conductor cleaning system according to claim 1, wherein the vibrator includes an eccentric weight adapted to be spun by a motor at a specified rate.

3. The portable electrical conductor cleaning system according to claim 1, further including an attachment rail connected to the housing such that the attachment rail is in parallel relation to the housing and the container, the attachment rail including a plurality of apertures to allow the conductor cleaning system to be secured to a support during a cleaning cycle.

4. The portable electrical conductor cleaning system according to claim 1, further including at least one retaining strap having a first end connected to a first side of the housing, the at least one retaining strap being adapted to secure the container in direct physical contact with the support, wherein when assembled, the retaining strap is wrapped around the container such that a second end of the at least one retaining strap is connected to a second side of the housing.

5. The portable electrical conductor cleaning system according to claim 1, further including a flexible baffle positioned in an end of the container to prevent splashes during a cleaning cycle, the baffle having a plurality of fingers extending inwardly towards a center of the baffle for receiving a conductor therethrough and into the container for cleaning.

6. The portable electrical conductor cleaning system according to claim 1, further including a plug adapted to be inserted into an end of the container to prevent the cleaning solution from exiting the container during transport of the conductor cleaning system.

7. The portable electrical conductor cleaning system according to claim 1, wherein the cleaning solution is a caustic solution containing NaOH.

8. A portable electrical conductor cleaning system, comprising:

(a) a removable tubular container having a pre-mixed cleaning solution contained therein, the container being adapted to receive a portion of a conductor to be cleaned by the cleaning solution;

(b) a housing adapted to receive and support the container, the housing having:

(i) a control system contained therein, the control system having a motor operably connected to a vibrator, the vibrator having an eccentric weight adapted to be spun by the motor at a specified rate to impart vibrations into the container such that the cleaning solution is agitated;

(ii) a v-shaped support disposed on a bottom of the housing, the support being adapted to straddle a portion of the container such that when the container is assembled with the housing, a surface of the container is in direct physical contact with the support to transmit vibrations from the vibrator into the container;

(iii) at least one guide strap adapted to guide and receive the container in parallel relation to the housing; and (iv) at least one retaining strap having a first end connected to a first side of the housing, the at least one retaining strap being adapted to secure the container in direct physical contact with the support;

(c) wherein when assembled, the container is slid between the at least one guide strap and the support to position the container in parallel relation to the housing and the retaining strap is wrapped around the container such that a second end of the at least one retaining strap is connected to a second side of the housing, thereby securing the container in direct physical contact with the support.

9. The portable electrical conductor cleaning system according to claim 8, further including a control panel having a power switch, a timer, and a start button electrically connected to the control system and adapted to control the conductor cleaning system.

10. The portable electrical conductor cleaning system according to claim 8, wherein the control system further includes a voltage regulator and a timer circuit.

11. The portable electrical conductor cleaning system according to claim 8, wherein the control system is powered by a battery positioned in a receptacle of the housing.

* * * * *